United States Patent [19]

Wilkinson

[11] 4,176,773

[45] Dec. 4, 1979

[54] HOLDER FOR CIGARETTE LIGHTER

[75] Inventor: Elizabeth P. Wilkinson, High Point, N.C.

[73] Assignee: Joseph Bostick, Estill, S.C.

[21] Appl. No.: 810,863

[22] Filed: Jun. 28, 1977

[51] Int. Cl.[2] ..... A45C 11/00

[52] U.S. Cl. ..... 224/205; 24/3 B; 150/11; 224/250

[58] Field of Search ..... 224/5 R, 5 A, 5 B, 5 H, 224/5 J, 5 L, 26 R, 26 B, 26 G, 26 H, 26 K, 27, 28 R, 28 B, 28 C, 28 D, 101, 181, 191, 201, 202, 203, 205, 219, 220, 250, 257, 265; 24/3 R, 3 A, 3 B, 3 E, 3 M; 150/11; 131/257; 431/343; 206/85, 86, 87

[56] References Cited

U.S. PATENT DOCUMENTS

| | | | |
|---|---|---|---|
| D. 171,247 | 1/1954 | Charnota | 224/5 A X |
| 916,802 | 3/1909 | Thompson | 150/11 |
| 1,208,728 | 12/1916 | Bartlett et al. | 224/5 R |
| 2,500,257 | 3/1950 | Mahan | 224/5 H |
| 2,911,694 | 11/1959 | Seron | 24/3 B X |
| 3,990,617 | 11/1976 | Carter | 224/5 H |
| 4,055,283 | 10/1977 | Habler | 224/5 R |

FOREIGN PATENT DOCUMENTS

| | | | |
|---|---|---|---|
| 1432121 | 2/1966 | France | 206/87 |

*Primary Examiner*—Stephen G. Kunin
*Assistant Examiner*—Winston H. Douglas
*Attorney, Agent, or Firm*—Stevens, Davis, Miller & Mosher

[57] ABSTRACT

A holder for a cigarette lighter includes a leather sleeve, open at both ends, for receiving the lighter. An inner surface of the sleeve is roughened for frictionally engaging the lighter and retaining the lighter in position in the sleeve, so that, an upper portion of the lighter including the lighter actuator protrudes beyound one of the open ends of the sleeve. A strap, attached to the sleeve, is configured in a closed loop and is of sufficient length to encircle the neck of a wearer to permit the lighter to hang loosely from the neck when not in use and of sufficient length to permit the lighter to be manually grasped and positioned to light a cigarette in the mouth of the wearer.

2 Claims, 5 Drawing Figures

Fig. 3
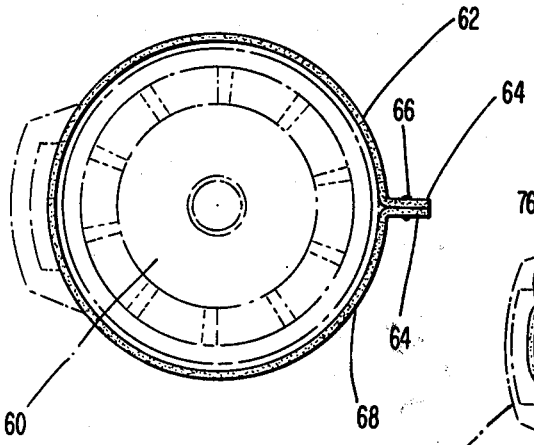
Fig. 4
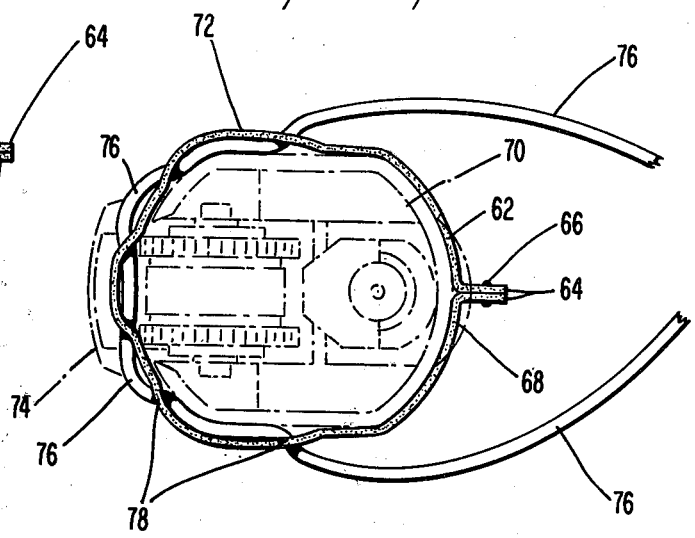
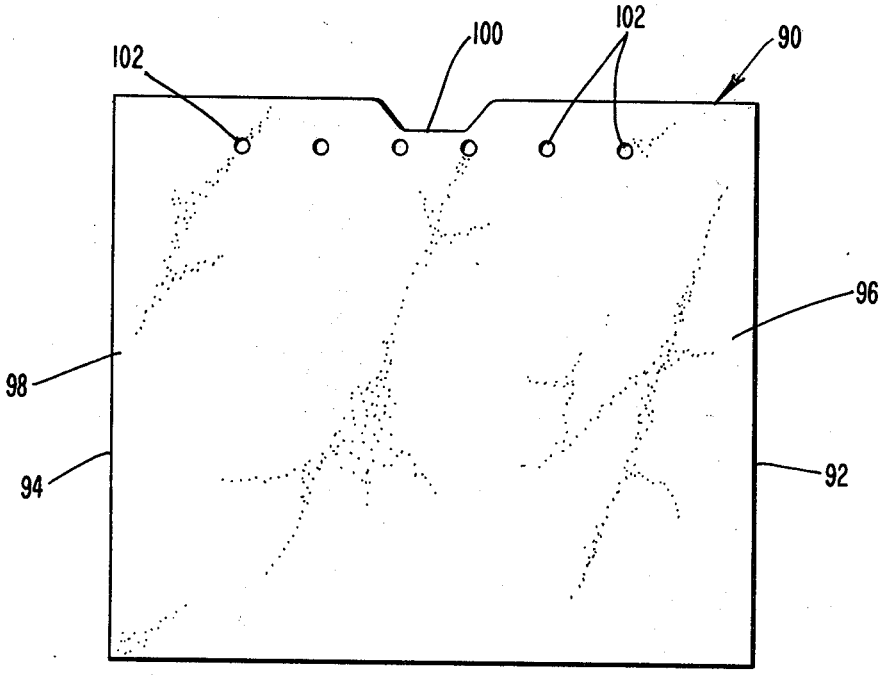
Fig. 5

HOLDER FOR CIGARETTE LIGHTER

BACKGROUND OF THE INVENTION

Inexpensive, disposable butane lighters have enjoyed increasing popularity in recent years. The present invention relates to an inexpensive and attractive leather holder for such cigarette lighters, adapted for carrying the lighter about the neck of a wearer.

Containers made of flexible sheet material, are well known in the prior art. Such containers are illustrated, for example, in U.S. Pat. No. 916,802 to Thompson and U.S. Pat. No. 2,253,688 to Collins. Typically the prior art containers include a flexible bottom wall portion and are adapted for carrying loose goods on the person such as tobacco products or bait, as is the case with the above-mentioned patents. The prior art also includes containers for carrying items, such as a camera, about the neck of a wearer. These containers typically have bottom walls and/or locking mechanisms for retaining the devices in the container. The containers known in the prior art are not well suited for use with butane lighters for the following reasons: (1) known containers are expensive to fabricate due to the requirement that they have a bottom wall or locking mechanism to retain the items carried therein, (2) known containers are not constructed to display the carried items in an ornamental fashion; and (3) known containers are not adapted to hold a cigarette lighter in such a way that the lighter is readily accessible and easily operated while held in the container and while the container is carried on the person of the wearer.

Accordingly, it is an object of the present invention to provide a holder for a cigarette lighter which is easily and inexpensively fabricated.

Another object of the present invention is to provide a cigarette lighter holder constructed without a bottom wall or locking mechanism for retaining the lighter in the holder.

Another object of the present invention is to provide a cigarette lighter holder, into which the lighter is easily inserted and in which the lighter is securely retained after insertion.

Another object of the present invention is to provide a holder for disposable butane lighters which is sufficiently inexpensive that it may be discarded with the lighter.

Another object of the present invention is to provide a leather holder for a disposable butane lighter which covers the plastic butane tank of the lighter while exposing the actuator mechanism for easy operation.

Another object of the present invention is to provide a cigarette lighter holder for carrying the lighter in an ornamental fashion about the neck of the wearer.

Another object of the present invention is to provide a cigarette lighter holder, adapted to be worn about the neck, which maintains the lighter in a vertical orientation, in a position similar to a pendant, with the actuator of the lighter located uppermost and exposed at all times for easy access and operation.

These and other objects and features of the present invention will become apparent from the following description when read in conjunction with the appended drawings.

THE DRAWINGS

FIG. 3 is a bottom view of a cigarette lighter holder embodiment of the present invention.

FIG. 4 is a top view of a cigarette lighter holder embodiment of the present invention.

FIG. 5 is a side view of a generally rectangular sheet from which a cigarette lighter holder embodiment of the present invention may be made.

DETAILED DESCRIPTION

Figure 1:
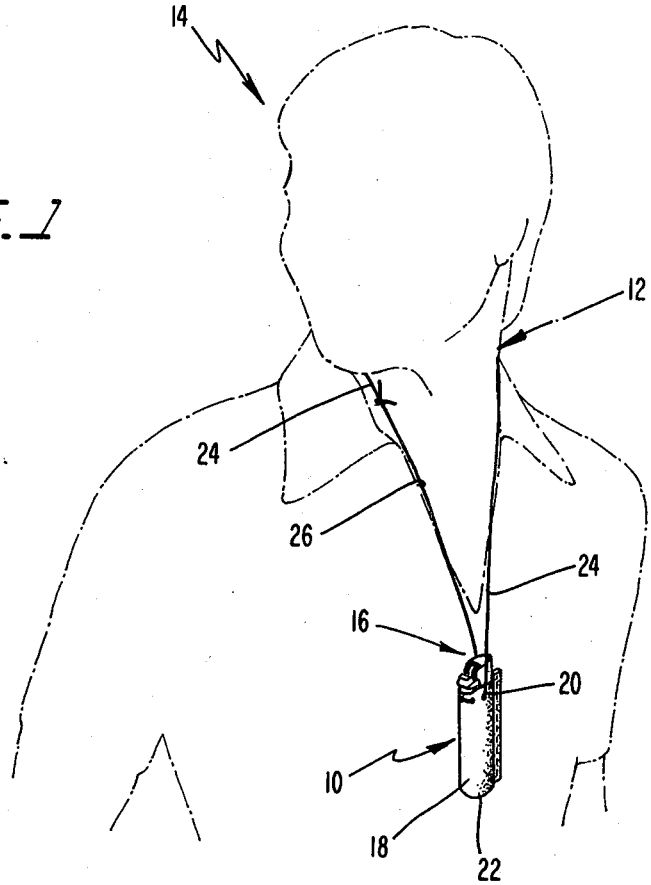
FIG. 1 is a pictorial view of a cigarette lighter holder embodiment of the present invention worn about the neck of a wearer.

Referring now to FIG. 1, a cigarette lighter holder 10 is shown worn about the neck 12 of a wearer 14. In the Figure, the cigarette lighter holder 10 is shown carrying a butane cigarette lighter 16.

The cigarette lighter holder 10 may include a leather sleeve 18 open at both its upper end 20 and lower end 22. A strap or leather thong 24 may be attached to the sleeve 10. Ends 26 of the strap 24 may be tied together to form a closed loop. The strap may be of sufficient length to encircle the neck 12 of the wearer to permit the lighter 16 to hang loosely from the neck when the lighter is not in use (as shown in FIG. 1). The strap 24 may also be of sufficient length to permit the lighter 16 and/or sleeve 18 to be manually grasped by the wearer and positioned to light a cigarette in the mouth of the wearer.

Figure 2:
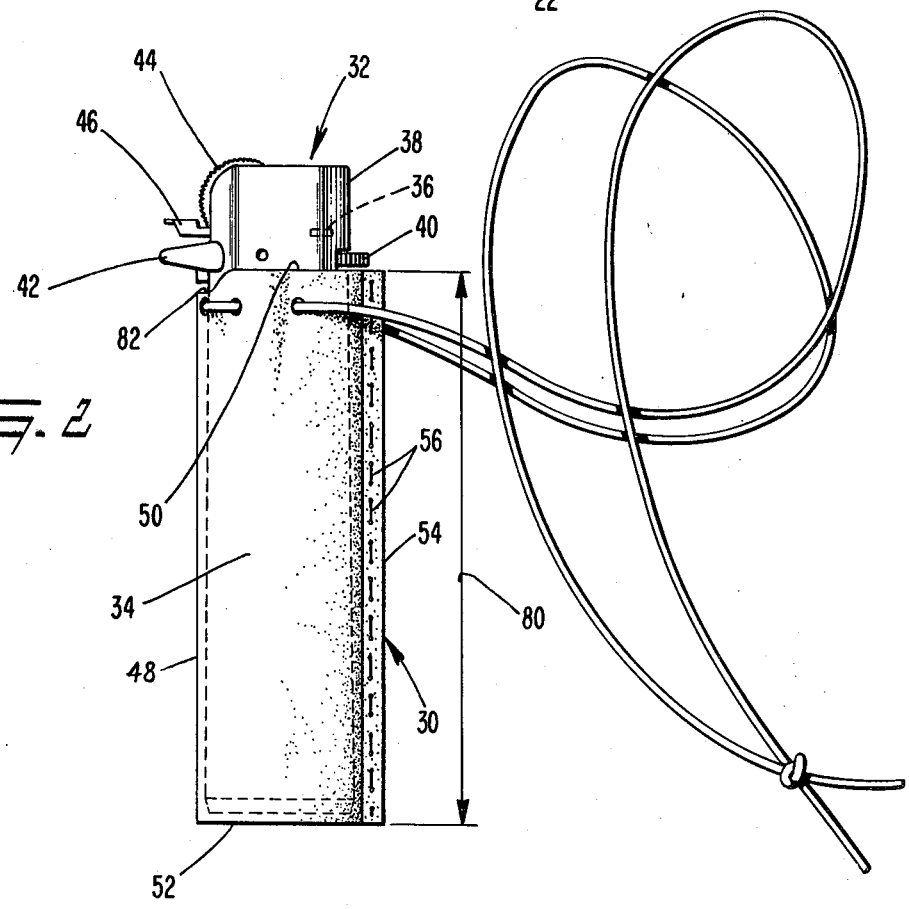
FIG. 2 is a pictorial view of a cigarette lighter holder embodiment of the present invention.

The construction and dimensioning of the sleeve 18 of the cigarette lighter holder 10 is described in greater detail in connection with FIG. 2. A cigarette lighter holder 30 is shown in FIG. 2 holding a conventional butane cigarette lighter 32. The cigarette lighter may be, for example, the butane lighter marketed by the Gillette Company under the trademark CRICKET or the butane lighter marketed by the BIC Company. Such lighters, which the cigarette lighter holder embodiments of the present invention are particularly adapted to carry, typically include a plastic butane tank 34 (shown in phantom) configured in the shape of a circular or elliptic cylinder. An upper portion of the lighter 32 may include a butane gas orifice 36 (shown in phantom) and a metal shield 38 encircling the orifice 36. Flow of gas from the orifice 36 may be regulated by a thumb wheel valve 40, which protrudes beyond a radially outermost surface of the butane tank 34 and the shield 38. A finger grip 42, located opposite the thumb wheel valve 40, may also protrude beyond the radially outermost surface of the butane tank 34 and shield 38.

An upper portion of the lighter 32 may include a mechanism for actuating the lighter. Typically, the mechanism comprises a finger actuatable wheel 44 located and configured to contact a flint (not shown) to generate an ignition spark for the lighter. The mechanism may also comprise a finger actuatable valve lever 46, operative to supply butane gas to the orifice 36 when depressed by the finger of the operator.

The cigarette lighter holder of the present invention is uniquely configured and dimensioned for use with a particular butane cigarette lighter such as that shown in FIG. 2. The holder 30 may include a leather sleeve 48 open at both its top end 50 and bottom end 52. The inner surface of the sleeve 48 may be roughened and the sleeve dimensioned so that the roughened inner surface frictionally engages the cylindrical butane tank 34 of the lighter 32. When so configured and dimensioned the lighter 32 may be inserted into the sleeve 48 wherein it will be retained by frictional contact with the roughened inner surface of the sleeve 48.

Advantageously, the sleeve 48 may be formed from a generally rectangular sheet of leather roughened on one side. The leather sheet may be folded to align opposite edges of the sheet 54. Portions of the sheet adjacent the aligned edges may be held together by stitches 56. This feature of the construction of the sleeve 48 is shown in greater detail in connection with FIGS. 3 and 4.

FIGS. 3 and 4 are, respectively, bottom and top views of a cigarette lighter holder embodiment of the present invention. FIG. 3 shows the engagement of the cylindrical cigarette lighter butane tank 60 by the sleeve 62. Portions 64 of the rectangular sheet from which the sleeve 62 is formed, are abutted and stitched together at 66 so that a roughened side of the portions 64 are in contact with one another. This construction permits the elastic expansion of the sleeve 62 to accommodate the cylindrical butane tank 60 of the lighter when the lighter is initially inserted into the holder. Once inserted into the holder the lighter is retained within the holder by frictional contact with the roughened inner surface of the sleeve 62.

FIG. 4 is a top view of a cigarette lighter holder embodiment of the present invention shown carrying the cigarette lighter 70. As shown in the Figure, the butane tank of the cigarette lighter 70 has been inserted within a leather sleeve 72 of the holder. In addition to the frictional engagement between the butane tank and the sleeve 72, the lighter may be held into position in the sleeve by engagement of the protruding finger grip 74 of the lighter with the sleeve 72. The lighter may also be held into position in the sleeve 72 by tightening the leather strap 76, which is laced through a plurality of holes 78 in the sleeve 72.

Referring once more to FIG. 2, the dimensions of the sleeve 48 are described in greater detail. The axial length of the sleeve 48 (denoted by the double ended arrow 80) may be of sufficient magnitude so that the sleeve 48 covers the butane tank 34 of the lighter 32. The circumferential dimension of the sleeve 48 may be of sufficient magnitude so that the roughened inner surface of the sleeve 48 is pressed tightly against the cylindrical tank 34 to frictionally engage the tank thereby retaining the tank and lighter 32 within the sleeve 48. The upper end 50 of the sleeve 48 may be formed with a cut-out such as cut-out 82 to accommodate the finger grip 42 and facilitate retention of the lighter within the sleeve 48 while permitting the sleeve 48 to cover the butane tank 34. Similarly, a cut-out (not shown) may be formed to accomodate the thumb wheel valve 40 to permit easy adjustment of the flame height of the lighter 32.

Referring now to FIG. 5, a generally rectangular sheet of leather 90 is shown, from which a cigarette lighter holder embodiment of the present invention may be made. Opposite edges 92 and 94 of the rectangular sheet 90 may be aligned and portions 96 and 98 of the rectangular sheet adjacent the edges 92 and 94, respectfully, may be stitched together to form a sleeve for retaining the cigarette lighter. The rectangular sheet may be formed with a cut-out 100 adapted to accommodate a finger grip or thumb wheel of the lighter as discussed in greater detail above. A plurality of holes 102 may be punched or otherwise formed in the rectangular sheet, for receiving the leather strap. Advantageously, the leather strap may be laced through the holes 102 so that the strap may act as a draw-string to tighten the sleeve around the cigarette lighter.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes may be made by those skilled in the art without departing from the spirit and scope of the present invention.

What is claimed is:

1. A holder for a cigarette lighter, adapted to be suspended from the neck of a wearer, comprising: a leather sleeve, open at both ends, formed from a generally rectangular flexible sheet of leather, folded to align two opposite edges thereof, wherein portions of the sheet adjacent the aligned edges are stitched together along the aligned edges, to form said sleeve, said sleeve having a roughened inner surface and being dimensioned to substantially cover a cylindrical butane tank and to permit the sleeve to receive and frictionally engage the lighter, so that the lighter is retained within the sleeve without providing a bottom end for the sleeve, and so that a portion of the lighter including an actuation member of the lighter protrudes beyond one of the open ends of said sleeve; and a strap, laced through a plurality of holes in said sleeve in the upper end of the sleeve, the ends of said strap being tied together to form a closed loop, said strap being of sufficient length to encircle the neck of the wearer to permit the lighter to hang loosely from the neck when the lighter is not in use and of sufficient length to permit the lighter to be manually grasped, actuated and positioned upright to light a cigarette in the mouth of the wearer.

2. The holder of claim 1 wherein a portion of an upper end of said sleeve through which a portion of the lighter protrudes is formed with a cut-out for receiving a finger-grip of the lighter extending from a cylindrical tank portion of the lighter; and wherein said strap is a leather thong laced through the plurality of holes in said sleeve in the upper end of the sleeve so that portions of the strap forming the loop extend from the sleeve on a side opposite to the cut-out.

* * * * *